US011078561B2

(12) United States Patent
Onodera et al.

(10) Patent No.: US 11,078,561 B2
(45) Date of Patent: Aug. 3, 2021

(54) SOFT MAGNETIC MATERIAL AND METHOD FOR PRODUCING THE SAME

(71) Applicant: TOYOTA JIDOSHA KABUSHIKI KAISHA, Toyota (JP)

(72) Inventors: Kiyotaka Onodera, Miyoshi (JP); Hidefumi Kishimoto, Susono (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 204 days.

(21) Appl. No.: 16/417,786

(22) Filed: May 21, 2019

(65) Prior Publication Data

US 2019/0368019 A1 Dec. 5, 2019

(30) Foreign Application Priority Data

May 30, 2018 (JP) ..... JP2018-103787

(51) Int. Cl.

| | |
|---|---|
| ***C22C 45/04*** | (2006.01) |
| ***C22C 33/00*** | (2006.01) |
| ***H01F 1/153*** | (2006.01) |
| ***C22C 45/02*** | (2006.01) |

(52) U.S. Cl.

CPC ..... *C22C 45/04* (2013.01); *C22C 33/003* (2013.01); *C22C 45/02* (2013.01); *H01F 1/15308* (2013.01); *C22C 2200/02* (2013.01); *C22C 2202/02* (2013.01)

(58) Field of Classification Search

CPC ... C22C 33/003; C22C 45/02; C22C 2200/02; C22C 2202/02; H01F 1/15308

See application file for complete search history.

(56) References Cited

U.S. PATENT DOCUMENTS

| | | | | |
|---|---|---|---|---|
| 2009/0266448 | A1 | 10/2009 | Ohta et al. | |
| 2018/0166213 | A1 * | 6/2018 | Makino | H01F 27/245 |

FOREIGN PATENT DOCUMENTS

| | | | | |
|---|---|---|---|---|
| JP | 2013-60665 | A | 4/2013 | |
| WO | 2017/006868 | A1 | 1/2017 | |
| WO | WO-2017006868 | A1 * | 1/2017 | C22C 45/02 |
| WO | 2018/025931 | A1 | 2/2018 | |

* cited by examiner

*Primary Examiner* — Anthony J Zimmer
*Assistant Examiner* — Jacob James Gusewelle
(74) *Attorney, Agent, or Firm* — Oliff PLC

(57) ABSTRACT

There are provided a soft magnetic material having a high saturation magnetization and a low coercive force and excellent in thermal endurance, and a method for producing the same. The present disclosure relates to a soft magnetic material represented by the following composition formula: $Fe_{100-x-y}B_xNi_y$, wherein x satisfies $10 \leq x \leq 16$ in at %, and y satisfies $0 < y \leq 4$ in at %, having a coercive force of 20 A/m or less, and having a coercive force characteristic decrease rate after a thermal endurance test {[(coercive force after thermal endurance test−coercive force before thermal endurance test)/coercive force before thermal endurance test]×100 (%)} of 20% or less, wherein the thermal endurance test is carried out by allowing the soft magnetic material to stand in a constant temperature oven at 170° C. in the air for 100 h, and a method for producing the same.

20 Claims, 4 Drawing Sheets

SOFT MAGNETIC MATERIAL AND METHOD FOR PRODUCING THE SAME

CROSS REFERENCE TO RELATED APPLICATIONS

The present application claims priority from Japanese patent application JP 2018-103787 filed on May 30, 2018 the content of which is hereby incorporated by reference into this application.

BACKGROUND

Technical Field

The present disclosure relates to a soft magnetic material and a method for producing the same. The present disclosure particularly relates to a soft magnetic material having a high saturation magnetization and a low coercive force and excellent in thermal endurance, and a method for producing the same.

Description of Related Art

In order to enhance the performance of components such as motors and reactors, both a high saturation magnetization and a low coercive force are awaited in soft magnetic materials used for the core portions of the components.

Examples of soft magnetic materials having a high saturation magnetization include Fe-based nanocrystalline soft magnetic materials. The Fe-based nanocrystalline soft magnetic materials mean soft magnetic materials whose main component is Fe and in which 30% by volume or more of nanocrystals are dispersed.

For example, JP 2013-60665 A describes a soft magnetic alloy represented by a composition formula: $Fe_{100-x-y}Cu_xB_y$, wherein $1<x<2$ and $10\leq y\leq 20$ in atomic percent (at %), or $Fe_{100-x-y-z}Cu_xB_ySi_z$, wherein $1<x<2$, $10\leq y\leq 20$, and $0<z\leq 9$ in at %, having a structure in which crystal grains of body-centered cubic structure having an average particle diameter of 60 nm or less are dispersed in an amorphous parent phase at a volume fraction of 30% or more, and having a saturation magnetic flux density of 1.7 T or more and a coercive force of less than 8 A/m, characterized by being obtained by heat-treating a Fe-based alloy having a structure in which crystal grains having an average particle diameter of 30 nm or less are dispersed in an amorphous parent phase at a volume fraction of 3% or more to less than 30%. JP 2013-60665 A further describes a single roll method as a method for quenching a molten metal.

International Publication No. WO 2018/025931 A1 describes a method for producing a soft magnetic material, comprising providing an alloy having a composition represented by the following composition formula 1 or composition formula 2 and having an amorphous phase; and heating the alloy at a heating rate of 10° C./s or more and holding the alloy at a temperature of a crystal formation start temperature or more to less than a Fe—B compound formation start temperature over 0 to 80 s, wherein the composition formula 1 is $Fe_{100-x-y}B_xM_y$, wherein M is at least one element selected from Nb, Mo, Ta, W, Ni, Co, and Sn, and x and y satisfy $10\leq x\leq 16$ and $0\leq y\leq 8$ in at %, and the composition formula 2 is $Fe_{100-a-b-c}B_aCu_bM'_c$, wherein M' is at least one element selected from Nb, Mo, Ta, W, Ni, and Co, and a, b, and c satisfy $10\leq a\leq 16$, $0<b\leq 2$, and $0\leq c\leq 8$ in at %.

For the performance improvement of a magnetic component such as a motor or a reactor, both a high saturation magnetization and a low coercive force of the soft magnetic material of the core portion are awaited, as described above.

A Fe-based nanocrystalline soft magnetic material has a high saturation magnetization because its main component is Fe. The Fe-based nanocrystalline soft magnetic material is obtained by heat-treating (also referred to as "annealing" in this specification and the like) an alloy having an amorphous phase. In a case where a Fe content in the alloy having an amorphous phase is high, when heat treatment is performed, a crystalline phase (α-Fe) forms easily from the amorphous phase, and the crystalline phase undergoes grain growth and coarsens easily. Accordingly, an element that suppresses grain growth is added to the material. However, the Fe content in the material decreases by an amount of the element added, and therefore the saturation magnetization of the material decreases. Because of the above situation, in a soft magnetic material, when its main component is Fe, it is difficult to suppress the coarsening of a crystalline phase during heat treatment to hold a low coercive force, while maintaining a high saturation magnetization.

Further, a temperature of use environment of a magnetic component may be high, and therefore improvement of thermal endurance of a soft magnetic material has also been awaited.

Accordingly, the present disclosure provides a soft magnetic material having a high saturation magnetization and a low coercive force and excellent in thermal endurance, and a method for producing the same.

SUMMARY

Examples of a method for improving a high saturation magnetization and a low coercive force of a soft magnetic material include a method of rapidly heating an alloy having an amorphous phase whose main component is Fe to a temperature region of a crystal formation start temperature or more to less than a Fe—B compound formation start temperature, and immediately cooling the alloy or holding the alloy for a short time, as described, for example, in International Publication No. WO 2018/025931 A1 (also referred to as "the method described in International Publication No. WO 2018/025931 A1" in this specification and the like). According to the method described in International Publication No. WO 2018/025931 A1, a soft magnetic material having low a coercive force can be obtained by the fining of a crystalline phase in a soft magnetic material.

However, the present inventors have produced a soft magnetic material having a low coercive force by selecting a temperature region in which coercive force characteristics are best, based on the method described in International Publication No. WO 2018/025931 A1, and carried out a thermal endurance test for the soft magnetic material, and newly discovered that the coercive force characteristics of the soft magnetic material after the thermal endurance test decrease compared with those before the thermal endurance test, that is, the coercive force of the soft magnetic material increases under a high temperature condition.

Accordingly, as a result of intensive studies, the present inventors have found that a Fe-based nanocrystalline soft magnetic material that maintains a low coercive force even after a thermal endurance test is obtained by heat-treating an alloy having an amorphous phase represented by the following composition formula: $Fe_{100-x-y}B_xNi_y$, wherein x satisfies $10\leq x\leq 16$ in at %, and y satisfies $0<y\leq 4$ in at %, in a temperature region of $\{T_1+0.88(T_2-T_1)\}$ or more to less than $T_2$, wherein $T_1$ is an α-Fe crystal formation start temperature, and $T_2$ is a Fe—B compound formation start temperature, and completed the present disclosure.

For example, exemplary embodiments are as follows.

(1) A soft magnetic material represented by the following composition formula:

$$Fe_{100-x-y}B_xNi_y$$

wherein x satisfies $10 \leq x \leq 16$ in at %, y satisfies $0 < y \leq 4$ in at %, part of B may be replaced by at least one element selected from the group consisting of Si, P, and C, the part of B is 3 at % or less based on an entire composition, part of Fe and Ni may be replaced by at least one element selected from Nb, Co, Zr, Hf, Cu, Ag, Au, Zn, Sn, As, Sb, Bi, Y, and rare earth elements, and the part of Fe and Ni is 3 at % or less based on the entire composition, having a coercive force of 20 A/m or less, and having a coercive force characteristic decrease rate after a thermal endurance test {[(coercive force after thermal endurance test−coercive force before thermal endurance test)/coercive force before thermal endurance test]×100(%)} of 20% or less, wherein the thermal endurance test is carried out by allowing the soft magnetic material to stand in a constant temperature oven at 170° C. in the air for 100 h.

(2) A method for producing a soft magnetic material, comprising:

providing an alloy having a composition represented by the following composition formula:

$$Fe_{100-x-y}B_xNi_y$$

wherein x satisfies $10 \leq x \leq 16$ in at %, y satisfies $0 < y \leq 4$ in at %, part of B may be replaced by at least one element selected from the group consisting of Si, P, and C, the part of B is 3 at % or less based on an entire composition, part of Fe and Ni may be replaced by at least one element selected from Nb, Co, Zr, Hf, Cu, Ag, Au, Zn, Sn, As, Sb, Bi, Y, and rare earth elements, and the part of Fe and Ni is 3 at % or less based on the entire composition, and having an amorphous phase; and heat-treating the alloy under conditions in which the alloy is heated at a heating rate of 10° C./s or more to a temperature region of $\{T_1+0.88(T_2-T_1)\}$ or more to less than $T_2$, wherein $T_1$ is an α-Fe crystal formation start temperature, and $T_2$ is a Fe—B compound formation start temperature, and held in the temperature region for a holding time of 0 to 80 s.

(3) The method according to (2), wherein a molten metal is quenched to provide the alloy.

(4) The method according to (2) or (3), wherein the heating rate is 125° C./s or more.

(5) The method according to (2) or (3), wherein the heating rate is 325° C./s or more.

(6) The method according to any one of (2) to (5), wherein the holding time is 3 s to 10 s.

(7) The method according to any one of (2) to (6), wherein the heat treatment is carried out by sandwiching the alloy between heated blocks.

Effect

The present disclosure provides a soft magnetic material having a high saturation magnetization and a low coercive force and excellent in thermal endurance, and a method for producing the same.

DETAILED DESCRIPTION OF THE EMBODIMENTS

Figure 1:
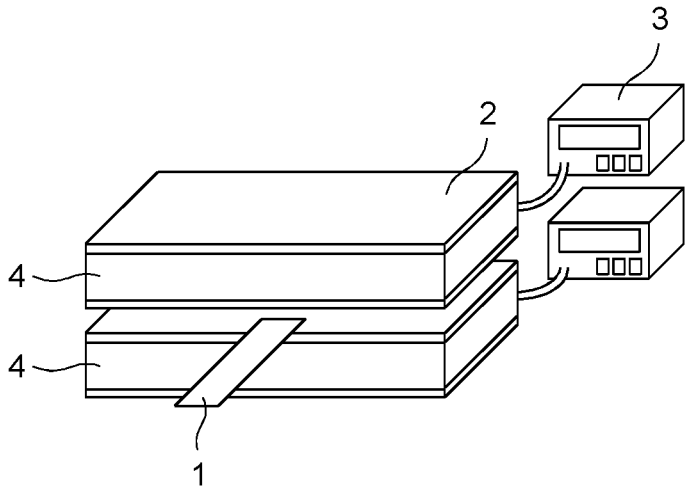
FIG. 1 is a perspective view showing the outline of an apparatus that sandwiches an amorphous alloy between blocks already heated to the desired holding temperature, to rapidly heat and hold the amorphous alloy.

Some embodiments of the present disclosure will be described in detail below.

In this specification, features of the present disclosure will be described with appropriate reference to the drawings. In the drawings, the dimensions and shapes of portions are exaggerated for clarification, and actual dimensions and shapes are not accurately depicted. Therefore, the technical scope of the present disclosure is not limited to the dimensions and shapes of the portions represented in these drawings. The soft magnetic material and the method for producing the same according to the present disclosure are not limited to the following embodiments and can be carried out in various forms subjected to changes, improvements, and the like that can be made by those skilled in the art without departing from the gist of the present disclosure.

In the soft magnetic material of the present disclosure, in order to achieve both magnetic characteristics, a high saturation magnetization and a low coercive force, and thermal endurance, an alloy whose main component is Fe and having an amorphous phase is rapidly heated to a temperature region of $\{T_1+0.88(T_2-T_1)\}$ or more to less than $T_2$, wherein $T_1$ is an α-Fe crystal formation start temperature, and $T_2$ is a Fe—B compound formation start temperature, and held in the temperature region for a short time.

In the present disclosure, "main component is Fe" means that a content of Fe in a material is 50 at % or more. An "alloy having an amorphous phase" means that 50% by volume or more of an amorphous phase is contained in an alloy, and this is sometimes simply referred to as an "amorphous alloy". An "alloy" has the form of a ribbon, a thin piece, a granular material, a bulk, or the like.

Although not bound by theory, it is considered that when an amorphous alloy is rapidly heated to a temperature region of $\{T_1+0.88(T_2-T_1)\}$ or more to less than $T_2$, wherein $T_1$ is an α-Fe crystal formation start temperature, and $T_2$ is a Fe—B compound formation start temperature, and held in the temperature region for a short time, the following phenomenon occurs in the amorphous alloy.

The amorphous alloy is rapidly heated to the temperature region and held in the temperature region for a short time. Therefore, it is considered that the coarsening of a microstructure of a crystalline phase is avoided, and the obtained crystalline phase is fined.

Here, a size of the microstructure depends on a heterogeneous nucleation rate, and the heterogeneous nucleation rate is governed by atomic transport and a size of a critical nucleus.

It is considered that a heterogeneous nucleation rate is increased in order to fine a microstructure, and atomic transport is increased and a size of a critical nucleus is decreased in order to increase the heterogeneous nucleation rate. In order to achieve these two conditions, it is effective to introduce a supercooled liquid region into an amorphous body. In the supercooled liquid region in the amorphous body, a viscous flow is very large, and therefore the strain energy due to nucleation in the supercooled liquid is much smaller than the strain energy due to nucleation in the amorphous body. Therefore, in the supercooled liquid region, many embryos become nuclei.

In conventional heat treatment (annealing), however, a heating rate is slow, and therefore the crystallization of an amorphous body starts at a relatively low temperature. Therefore, at the relatively low temperature, transition from a solid to a supercooled liquid is limited, and heterogeneous nucleation is also very limited.

In contrast to the above situation, when an amorphous alloy is heated by rapid heating in which a heating rate is increased, as in the present disclosure, the α-Fe crystal formation start temperature for the amorphous alloy increases. Then, the amorphous phase can be held in an amorphous body state to a high temperature at which transition of the amorphous body to a supercooled liquid occurs actively. When the amorphous body transitions to the supercooled liquid, atomic transport increases, and the size of the critical nucleus decreases, and the heterogeneous nucleation rate increases. As a result, the nucleation frequency also increases.

Therefore, rapidly heating an amorphous alloy can provide high atomic transport in a region in which a supercooled liquid is formed, resulting in active nucleation.

On the other hand, when an amorphous alloy is rapidly heated, a grain growth rate also increases. In the present disclosure, the holding time is decreased, and thus the grain growth time decreases, resulting in suppression of grain growth.

In addition, it is considered that in a crystallization process, when the thermal energy provided to an amorphous alloy is insufficient (for example, a heat treatment temperature is low), the diffusion of atoms in the amorphous alloy is insufficient, and the heat treatment is completed in an unstable state. Then, for example, when the obtained soft magnetic material is used under a high temperature environment, the migration of atoms occurs in the material due to the thermal energy applied from the use environment, and the short-range structure of the material changes. As a result, there is a possibility that the magnetic characteristics of the material decrease, for example, the coercive force of the material increases.

In the present disclosure, an alloy having an amorphous phase is heated to a temperature of $\{T_1+0.88(T_2-T_1)\}$ or more, wherein $T_1$ is an α-Fe crystal formation start temperature, and $T_2$ is a Fe—B compound formation start temperature, and therefore the diffusion of atoms in the amorphous alloy is sufficiently performed, and, for example, even when the obtained soft magnetic material is used under a high temperature environment, the migration of atoms (mainly the migration of B atoms) due to the thermal energy applied from the use environment is suppressed, and as a result, in the magnetic characteristics of the material, particularly, the coercive force is kept low and stabilized.

On the other hand, when a temperature of an amorphous alloy reaches a Fe—B compound formation start temperature, Fe—B compounds form. The Fe—B compounds have large magneto crystalline anisotropy and therefore increase a coercive force.

Therefore, when an amorphous alloy is heated to a temperature of less than $T_2$, wherein $T_2$ is a Fe—B compound formation start temperature, the formation of Fe—B compounds can be suppressed, and as a result, in the characteristics, particularly, the magnetic characteristics can be well maintained.

Rapid heating may be carried out in a temperature region of $\{T_1+0.88(T_2-T_1)\}$ or more to less than $T_2$, wherein $T_1$ is an α-Fe crystal formation start temperature, and $T_2$ is a Fe—B compound formation start temperature. However, when an amorphous alloy is slowly heated in a temperature region less than a temperature of $\{T_1+0.88(T_2-T_1)\}$, it is difficult to immediately shift to rapid heating when a temperature of the amorphous alloy reaches a temperature of $\{T_1+0.88(T_2-T_1)\}$. In addition, even if an amorphous alloy is rapidly heated in a temperature region less than a temperature of $\{T_1+0.88(T_2-T_1)\}$, no special problems arise. Therefore, an amorphous alloy may be rapidly heated from when the amorphous alloy is at a temperature less than a temperature of $\{T_1+0.88(T_2-T_1)\}$, and continuously rapidly heated as it is even after the amorphous alloy reaches a temperature of $\{T_1+0.88(T_2-T_1)\}$.

From the phenomenon described so far, the present inventors have discovered that in order to achieve both magnetic characteristics, a high saturation magnetization and a low coercive force, and thermal endurance, it is good to perform heat treatment in which an amorphous alloy is rapidly heated to a temperature region of $\{T_1+0.88(T_2-T_1)\}$ or more to less than $T_2$, wherein $T_1$ is an α-Fe crystal formation start temperature, and $T_2$ is a Fe—B compound formation start temperature, and immediately cooled or held at the temperature that the amorphous alloy reaches, for a short time.

Next, the configuration of a detailed production method for a soft magnetic material according to the present disclosure, based on these discoveries, will be described.

(Step of Providing Amorphous Alloy)

An alloy having an amorphous phase (amorphous alloy) is provided. As described above, the amorphous alloy has 50% by volume or more of an amorphous phase. From the viewpoint of rapidly heating and holding the amorphous alloy to obtain more fine crystalline phases, a content of the amorphous phase in the amorphous alloy is 60% by volume or more in some embodiments, 70% by volume or more in other embodiments, and 90% by volume or more in some other embodiments.

The amorphous alloy has a composition represented by a composition formula:

$$Fe_{100-x-y}B_xNi_y$$

In the composition formula, x satisfies $10 \le x \le 16$ in at %, and y satisfies $0 < y \le 4$ in at %. x represents a content of B, and y represents a content of Ni.

For the amorphous alloy of the composition formula, its main component is Fe, that is, a content of Fe is 50 at % or more based on an entire composition. The content of Fe is represented by the remainder after the subtraction of the contents of B and Ni. From the viewpoint that a soft magnetic material obtained by rapidly heating and holding the amorphous alloy has a high saturation magnetization, the content of Fe is 80 at % or more in some embodiments, 84 at % or more in other embodiments, and 88 at % or more in some other embodiments, based on the entire composition.

The amorphous alloy is obtained by quenching a molten metal whose main component is Fe. B (boron) promotes the formation of an amorphous phase when the molten metal is quenched. When the content of B (amount of B remaining) in the amorphous alloy obtained by quenching the molten metal is 10 at % or more based on the entire composition, a main phase of the amorphous alloy is an amorphous phase. As described above, a main phase of an alloy being an amorphous phase means that a content of an amorphous phase in an alloy is 50% by volume or more. In order that a main phase of an alloy is an amorphous phase, the content of B in the amorphous alloy is 11 at % or more in some embodiments and 12 at % or more in other embodiments, based on the entire composition. On the other hand, when the content of B in the amorphous alloy is 16 at % or less based on the entire composition, the formation of Fe—B compounds can be avoided at the time of the crystallization of the amorphous phase. From the viewpoint of avoiding the formation of the compounds, the content of B in the amorphous alloy is 15 at % or less in some embodiments and 14 at % or less in other embodiments, based on the entire composition.

The amorphous alloy comprises Ni (nickel). When the amorphous alloy contains Ni, the magnitude of induced magnetic anisotropy can be controlled. From the viewpoint that the exhibition of the action is clear, the content of Ni is 0.2 at % or more in some embodiments, 0.5 at % or more in other embodiments, and 1 at % or more in some other embodiments, based on the entire composition. On the other hand, when the content of Ni is 4 at % or less, 3.5 at % or less in some embodiments, and 3 at % or less in other embodiments, based on the entire composition, the amounts of Fe and B, other essential elements of the amorphous alloy, are not excessively small, and as a result, the soft magnetic material obtained by rapidly heating and holding the amorphous alloy can achieve both a high saturation magnetization and a low coercive force.

In the amorphous alloy, in the composition formula, part of B may be replaced by at least one element selected from the group consisting of Si, P, and C, and the part of B is 3 at % or less and 2 at % or less in some embodiments, based on the entire composition. When two or more types of elements are selected as the part of B, the part of B is the total content of these elements.

Si is an element that serves amorphous formation, and by adding Si, a temperature at which Fe—B compounds having large magneto crystalline anisotropy form increases, and therefore a heat treatment temperature can be made higher. In addition, the viscosity of the molten metal also decreases, and therefore the molten metal is easily discharged, and nozzle clogging can be suppressed. By adding amorphous-forming elements, P and C, in addition to Si, the randomness of atoms is improved, and the amorphous-forming ability and the stability of nanocrystals can be increased.

In the amorphous alloy, in the composition formula, part of Fe and Ni may be replaced by at least one element selected from Nb, Co, Zr, Hf, Cu, Ag, Au, Zn, Sn, As, Sb, Bi, Y, and rare earth elements, and the part of Fe and Ni is 3 at % or less and 2 at % or less in some embodiments, based on the entire composition. When two or more types of elements are selected as the part of Fe and Ni, the part of Fe and Ni is the total content of these elements.

For the improvement of corrosion resistance, the suppression of crystal grain growth, and the improvement of a nucleation frequency, part of Fe and Ni may be replaced by atoms (Nb, Co, Zr, Hf, Cu, Ag, Au, Zn, Sn, As, Sb, Bi, Y, and rare earth elements) in a range that does not remarkably decrease a saturation magnetization.

The amorphous alloy may further comprise unavoidable impurities such as Mn, S, Cr, O, and N. The unavoidable impurities mean impurities such that avoiding containing them is inevitable, or that a remarkable increase in production cost is caused in order to avoid them, such as impurities contained in raw materials. The purity of the amorphous alloy when the amorphous alloy comprises such unavoidable impurities is 97% by mass or more in some embodiments, 98% by mass or more in other embodiments, and 99% by mass or more in some other embodiments.

(Step of Rapidly Heating and Holding Amorphous Alloy) The amorphous alloy is heated at a heating rate of 10° C./s or more and held in a temperature region of $\{T_1+0.88(T_2-T_1)\}$ or more to less than $T_2$, wherein $T_1$ is an α-Fe crystal formation start temperature, and $T_2$ is a Fe—B compound formation start temperature, over 0 to 80 s.

Here, $T_1$ that is an α-Fe crystal formation start temperature or $T_2$ that is a Fe—B compound formation start temperature can be determined as follows.

(i) The alloy having the composition represented by the composition formula and having an amorphous phase is analyzed in DSC measurement to obtain a profile f(T) of a heat flux with respect to a temperature. The DSC measurement is usually carried out under an inert atmosphere, for example, under an Ar atmosphere, and a heating rate is usually 10° C./min to 100° C./min and is 20° C./min to 50° C./min in some embodiments.

(ii) A tangent passing through the point where the slope is largest in the rising portion of an exothermic peak in the profile obtained in (i) is drawn.

(iii) The intersection point where the tangent obtained in (ii) and the baseline of the profile intersect is taken as $T_1$ that is the α-Fe crystal formation start temperature or $T_2$ that is the Fe—B compound formation start temperature.

When the heating rate is 10° C./s or more, the crystalline phase does not coarsen. From the viewpoint of avoiding the coarsening of the crystalline phase, the heating rate is fast in some embodiments, and therefore the heating rate is 45° C./s or more in some embodiments, 125° C./s or more in other embodiments, 150° C./s or more in some other embodiments, and 325° C./s or more in some particular embodiments. On the other hand, when the heating rate is very fast, the heat source for heating is too large, impairing economy. From the viewpoint of the heat source, the heating rate is 415° C./s or less in some embodiments. The heating rate may be an average rate from the start of heating to the start of holding. In the case of a holding time of 0 s, the heating rate may be an average rate from the start of heating to the start of cooling. Alternatively, the heating rate may be an average rate in a particular temperature range. For example, the heating rate may be an average rate between 100° C. and 400° C.

When the holding time is 0 s or more, a fine crystalline phase is obtained from an amorphous phase. The holding time being 0 s means that after rapid heating, the amorphous alloy is immediately cooled, or holding is completed. The holding time is 3 s or more in some embodiments. On the other hand, when the holding time is 80 s or less, the coarsening of the crystalline phase can be avoided. From the viewpoint of avoiding the coarsening of the crystalline phase, the holding time is 60 s or less in some embodiments, 40 s or less in other embodiments, 20 s or less in some other embodiments, 17 s or less in some particular embodiments, and 10 s or less in other particular embodiments.

When a holding temperature is equal to or more than a temperature of $\{T_1+0.88(T_2-T_1)\}$, the amorphous phase can be converted into a crystalline phase, and the formed nanocrystalline structure can be stabilized. On the other hand, when the holding temperature is equal to or more than $T_2$ that is a Fe—B compound formation start temperature, strong magneto crystalline anisotropy occurs due to the formation of Fe—B compounds, and as a result, the coercive force increases. Therefore, by holding the amorphous alloy at the highest temperature not reaching $T_2$ that is a Fe—B compound formation start temperature, the crystalline phase can be fined without forming the Fe—B compounds.

As long as the amorphous alloy can be heated at the heating rate described so far, a heating method is not particularly limited.

When the amorphous alloy is heated using a usual atmosphere furnace, it is effective to set the heating rate of the atmosphere in the furnace higher than the desired heating rate for the amorphous alloy. Similarly, it is effective to set the temperature of the atmosphere in the furnace higher than the desired holding temperature for the amorphous alloy. For example, when it is desired to heat the amorphous alloy at 150° C./s and hold the amorphous alloy at 480° C., it is effective to heat the atmosphere in the furnace at 170° C./s and hold the atmosphere in the furnace at 500° C.

When an infrared furnace is used instead of the usual atmosphere furnace, the time lag between the amount of heat input to the infrared heater and the amount of heat received by the amorphous alloy can be reduced. The infrared furnace is a furnace in which light emitted by an infrared lamp is reflected by a depressed surface to rapidly heat a material to be heated.

Further, the amorphous alloy may be rapidly heated and held by heat transfer between solids. FIG. 1 is a perspective view showing the outline of an apparatus that sandwiches an amorphous alloy between blocks already heated to the desired holding temperature, to rapidly heat and hold the amorphous alloy.

An amorphous alloy 1 is placed so as to be able to be sandwiched between blocks 2. The blocks 2 are provided with heating wires (heating elements) and heat-insulating materials 4. Temperature controllers 3 are coupled to the heating wires. The amorphous alloy 1 can be heated by sandwiching the amorphous alloy 1 between the blocks 2 previously heated, so that heat transfer between solids occurs between the amorphous alloy 1 and the blocks 2. For the blocks 2, the material and the like of the blocks 2 are not particularly limited as long as heat transfer is efficiently performed between the amorphous alloy 1 and the blocks 2. Examples of the material of the blocks 2 include metals, alloys, and ceramics.

When an amorphous alloy is heated, the amorphous alloy itself generates heat due to the heat released when an amorphous phase crystallizes. In particular, when an amorphous alloy is rapidly heated, the temperature of the alloy rapidly increases since the generated heat is not released from the alloy. Therefore, when the amorphous alloy is rapidly heated using an atmosphere furnace, an infrared furnace, or the like, it is difficult to control a temperature considering the heat generation of the amorphous alloy itself. Therefore, when an atmosphere furnace, an infrared furnace, or the like is used, a temperature of the amorphous alloy is higher than the target, often causing the coarsening of the crystalline phase. In contrast to the above situation, when the amorphous alloy 1 is heated by sandwiching the amorphous alloy 1 between the heated blocks 2 as shown in FIG. 1, it is easy to control a temperature considering the self-heat generation of the amorphous alloy. Therefore, when the amorphous alloy is rapidly heated as shown in FIG. 1, the temperature of the amorphous alloy is not higher than the target, and the coarsening of the crystalline phase can be avoided.

In addition, when the amorphous alloy is rapidly heated as shown in FIG. 1, the temperature of the amorphous alloy can be precisely controlled, and therefore the amorphous alloy can be easily held in a temperature region of $\{T_1+0.88(T_2-T_1)\}$ or more to less than $T_2$, wherein $T_1$ is an α-Fe crystal formation start temperature, and $T_2$ is a Fe—B compound formation start temperature. As a result, without forming the Fe—B compounds, the amorphous phase can be converted into a fine crystalline phase, the so-called nanocrystalline structure, and the nanocrystalline structure can be stabilized.

(Method for Producing Amorphous Alloy)

Next, a method for producing the amorphous alloy will be described. As long as the amorphous alloy having the composition represented by the composition formula is obtained, the method for producing the amorphous alloy is not limited. As described above, an alloy has the form of a ribbon, a thin piece, a granular material, a bulk, or the like. In order to obtain the desired form, a method for producing the amorphous alloy can be appropriately selected.

Examples of the method for producing the amorphous alloy include previously providing an ingot blended so that the amorphous alloy has the composition represented by the composition formula, melting this ingot to obtain a molten metal, and quenching the molten metal to obtain the amorphous alloy. When there is an element that decreases during the melting of an ingot, an ingot having a composition, wherein the decrement is previously added, is provided. When an ingot is ground and melted, the ingot is subjected to homogenization heat treatment before grinding in some embodiments.

The method for quenching the molten metal may be an ordinary method, and the examples of the method include a single roll method using a cooling roll made of copper, a copper alloy, or the like. The peripheral speed of the cooling roll in the single roll method may be standard peripheral speed when an amorphous alloy whose main component is Fe is produced. The peripheral speed of the cooling roll may be, for example, 15 m/s or more, 30 m/s or more, or 40 m/s or more and 55 m/s or less, 70 m/s or less, or 80 m/s or less.

The temperature of the molten metal when the molten metal is discharged onto the single roll is 50° C. to 300° C. higher than the melting point of the ingot in some embodiments. The atmosphere when the molten metal is discharged is not particularly limited but is an atmosphere of an inert gas or the like in some embodiments from the viewpoint of reducing mixing of oxides and the like into the amorphous alloy.

(Soft Magnetic Material)

The soft magnetic material of the present disclosure is a soft magnetic material represented by the following composition formula:

$$Fe_{100-x-y}B_xNi_y$$

wherein x satisfies $10 \le x \le 16$ in at %, y satisfies $0 < y \le 4$ in at %, part of B may be replaced by at least one element selected from the group consisting of Si, P, and C, the part of B is 3 at % or less based on an entire composition, part of Fe and Ni may be replaced by at least one element selected from Nb, Co, Zr, Hf, Cu, Ag, Au, Zn, Sn, As, Sb, Bi, Y, and rare earth elements, and the part of Fe and Ni is 3 at % or less based on the entire composition.

The composition of the amorphous alloy does not change in the production process of the soft magnetic material of the present disclosure, and therefore the composition of the soft magnetic material of the present disclosure is the same as the composition of the amorphous alloy used for production.

The soft magnetic material of the present disclosure has a coercive force characteristic decrease rate after a thermal endurance test {[(coercive force after thermal endurance test−coercive force before thermal endurance test)/coercive force before thermal endurance test]×100(%)} of 20% or less and 10% or less in some embodiments, wherein the thermal endurance test is carried out by allowing the soft magnetic material to stand in a constant temperature oven at 170° C. in the air for 100 h. Here, for the soft magnetic material of the present disclosure, the thermal endurance test can be carried out by allowing the soft magnetic material to stand in a constant temperature oven at 130° C. to 200° C. and 170° C. to 200° C. in some embodiments in the air for 24 h to 100 h. In some embodiments, the soft magnetic material of the present disclosure has a coercive force characteristic decrease rate of 20% or less and 10% or less in some embodiments even when the thermal endurance test is carried out by allowing the soft magnetic material to stand in a constant temperature oven at 170° C. in the air for 100 h.

The coercive force of the soft magnetic material of the present disclosure is 20 A/m or less, 15 A/m or less in some embodiments, 13 A/m or less in other embodiments, 12 A/m or less in some particular embodiments, and, for example, 1 A/m to 20 A/m, 5 A/m to 15 A/m, or 5 A/m to 12 A/m.

The soft magnetic material of the present disclosure can be used as the core of an electronic component such as a motor or a reactor.

EXAMPLES

Some Examples regarding the present disclosure will be described below, but it is not intended to limit the present disclosure to those shown in such Examples.

(Making of Amorphous Alloy)

Raw materials were weighed so as to obtain the following composition: $Fe_{84}B_{13}Ni_3$, and these raw materials were arc-melted to make an ingot. As the raw materials, pure Fe, a Fe—B alloy, pure Ni, and the like were used. In the step, the raw materials were inverted and repeatedly melted (three times to five times) so that the ingot was homogeneous.

The ingot cut into small pieces was charged into the nozzle of a liquid quenching apparatus (single roll method) and melted under an inert atmosphere by high frequency heating to obtain a molten metal. Then, the molten metal was discharged onto a copper roll at a peripheral speed of 30 m/s to 70 m/s and quenched to obtain a ribbon-shaped amorphous alloy having a width of 1 mm and a thickness of 17 μm. The temperature during the discharge was the melting point+50° C. to 200° C. The quenching conditions were adjusted by setting the gap at 0.4 mm, and controlling the pressure in the chamber and the pressure in the nozzle so that the discharge pressure was 40 kPa to 80 kPa.

The amorphous alloy was confirmed to be amorphous by performing X-ray diffraction (XRD) analysis before heat treatment described next. In addition, for the amorphous alloy, the relationship between the temperature and the heat flux was measured using differential scanning calorimetry (DSC, conditions: Ar atmosphere, heating rate 40° C./min). Further, from the obtained results of DSC, the α-Fe crystal formation start temperature $T_1$ and the Fe—B compound formation start temperature $T_2$ were determined by the following method.

(i) The alloy having the composition of $Fe_{84}B_{13}Ni_3$ and having an amorphous phase was analyzed in DSC measurement to obtain a profile f(T) of the heat flux with respect to the temperature.

(ii) A tangent passing through the point where the slope was largest in the rising portion of an exothermic peak in the profile obtained in (i) was drawn.

(iii) The intersection point where the tangent obtained in (ii) and the baseline of the profile intersected was taken as $T_1$ that was the α-Fe crystal formation start temperature or $T_2$ that was the Fe—B compound formation start temperature.

As a result, in the amorphous alloy having the composition of $Fe_{84}B_{13}Ni_3$, the α-Fe crystal formation start temperature $T_1$ was 391° C., and the Fe—B compound formation start temperature $T_2$ was 487° C.

Figure 2:
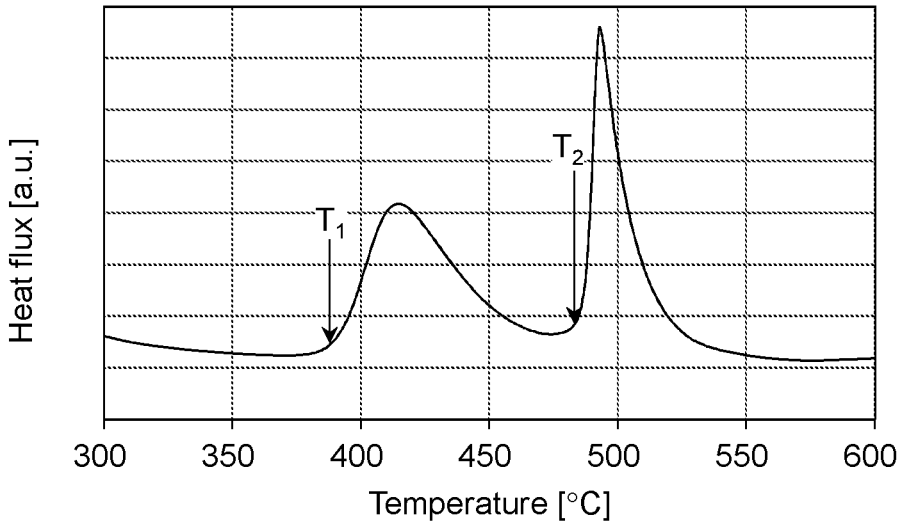
FIG. 2 is a diagram showing the relationship between the temperature and the heat flux, and determined $T_1$ and $T_2$, for the amorphous alloy having the composition of $Fe_{84}B_{13}Ni_3$ made in (Making of Amorphous Alloy) in EXAMPLES.

FIG. 2 shows the relationship between the temperature and the heat flux, and the determined $T_1$ and $T_2$, for the amorphous alloy having the composition of $Fe_{84}B_{13}Ni_3$.

From this, $\{T_1+0.88(T_2-T_1)\}$ for the amorphous alloy having the composition of $Fe_{84}B_{13}Ni_3$ was $$391+0.88\times96=475.48.$$

(Heat Treatment of Amorphous Alloy)

As shown in FIG. 1, the amorphous alloy having the composition of $Fe_{84}B_{13}Ni_3$ was sandwiched between heated blocks, and the amorphous alloy was heated at a predetermined heat treatment temperature for 3 s to 10 s. This heating crystallized the amorphous phase in the amorphous alloy to provide a sample of a soft magnetic material. The heating rate was 357° C./s. The heat treatment temperature means the set temperature of the heating apparatus, and the temperature that the amorphous alloy itself reaches is a temperature lower than the set temperature of the heating apparatus.

(Evaluation of Samples)

For the sample after each heat treatment, the final product, the particle diameter, and whether Fe—B compounds formed or not were confirmed using XRD. In Examples 1 to 4, no Fe—B compounds were formed. Then, for the sample after each heat treatment, the coercive force was measured using a direct current BH analyzer. Then, the sample was placed in a constant temperature oven set at 170° C., under an air atmosphere, and held for 24 h. After a lapse of 24 h, the sample was removed from the constant temperature oven, and the coercive force was measured using the direct current BH analyzer. After the coercive force measurement, the sample was placed in the constant temperature oven again and further held for 76 h. After a lapse of 76 h (the total holding time in the constant temperature oven is 24+76=100 h), the coercive force was measured.

The results are shown in Table 1. In Table 1, the heat treatment temperature of the amorphous alloy having the composition of $Fe_{84}B_{13}Ni_3$, the coercive force before the thermal endurance test, the coercive force 24 h after the thermal endurance test, the coercive force 100 h after the thermal endurance test, and the coercive force characteristic decrease rate 100 h after the thermal endurance test are shown together.

The coercive force characteristic decrease rate 100 h after the thermal endurance test was calculated from the following calculation formula:

coercive force characteristic decrease rate=[(coercive force after thermal endurance test−coercive force before thermal endurance test)/coercive force before thermal endurance test]×100(%)

TABLE 1

| No. | Heat treatment temperature [° C.] | Coercive force before thermal endurance test [A/m] | Coercive force after thermal endurance test [A/m] 24 h | 100 h | Coercive force characteristic decrease rate [%] |
|---|---|---|---|---|---|
| Comparative Example 1 | 450 | 12.1 | 23.9 | 27.5 | 126.4 |
| Comparative Example 2 | 460 | 9.4 | 14.6 | 16.9 | 80.1 |
| Comparative Example 3 | 470 | 7.8 | 14.6 | 16.9 | 118.1 |
| Comparative Example 4 | 475 | 7.2 | 12.6 | 13.7 | 90.4 |
| Example 1 | 480 | 8.9 | 9.7 | 10.2 | 14.0 |
| Example 2 | 485 | 8.8 | 10.2 | 10.5 | 19.1 |
| Example 3 | 490 | 10.2 | 10.9 | 11.4 | 11.5 |
| Example 4 | 495 | 10.6 | 11.6 | 11.8 | 11.2 |
| Comparative Example 5 | 500 | 21.3 | 24.6 | 23.1 | 8.2 |

Figure 3:
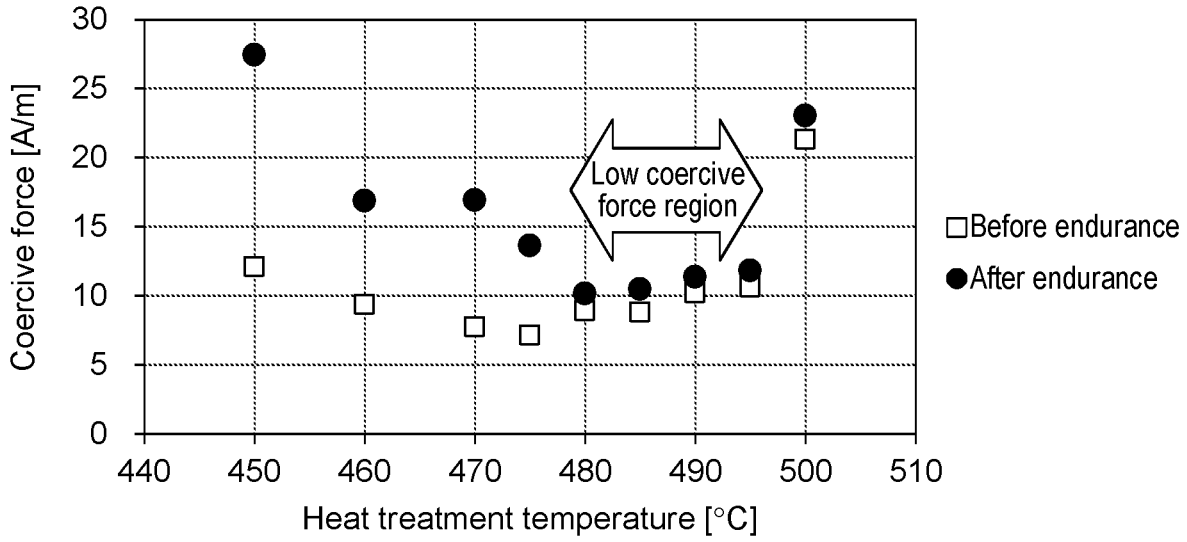
FIG. 3 is a diagram showing the relationship between the heat treatment temperature, and the coercive force before the thermal endurance test (before endurance) and the coercive force after the thermal endurance test (after endurance) of the obtained soft magnetic materials, for the amorphous alloys having the composition of $Fe_{84}B_{13}Ni_3$ made in (Making of Amorphous Alloy) in EXAMPLES.
Figure 4:
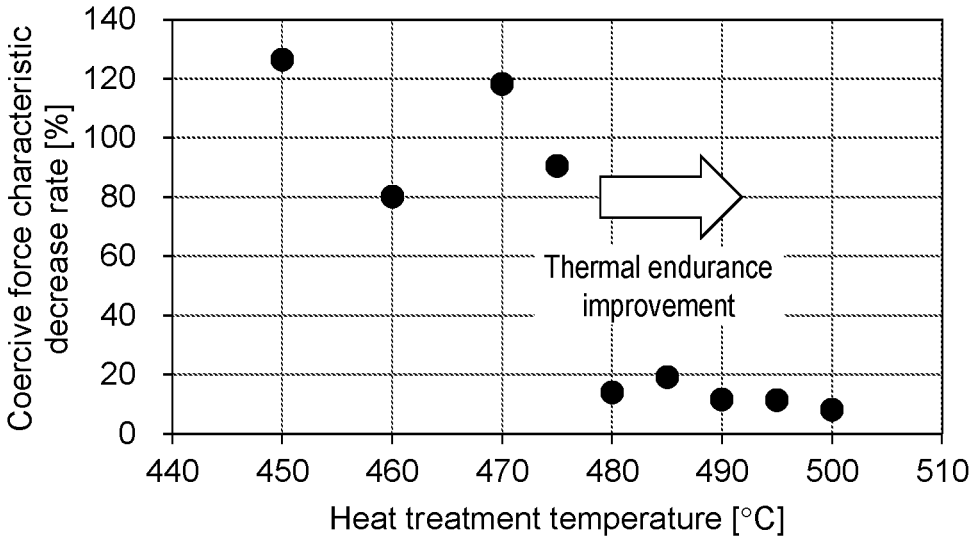
FIG. 4 is a diagram showing the relationship between the heat treatment temperature and the coercive force characteristic decrease rate for the amorphous alloys having the composition of $Fe_{84}B_{13}Ni_3$ made in (Making of Amorphous Alloy) in EXAMPLES.

Further, FIG. 3 shows the relationship between the heat treatment temperature of the amorphous alloy having the composition of $Fe_{84}B_{13}Ni_3$, and the coercive force before the thermal endurance test (before endurance) and the coercive force 100 h after the thermal endurance test (after endurance). FIG. 4 shows the relationship between the heat treatment temperature of the amorphous alloy having the composition of $Fe_{84}B_{13}Ni_3$ and the coercive force characteristic decrease rate 100 h after the thermal endurance test.

From the results in FIG. 3, it was found that when the temperature that the amorphous alloy having the composition of $Fe_{84}B_{13}Ni_3$ itself reached was 487° C. or more, the coercive force increased suddenly. It is considered that Fe—B compounds were formed and the crystalline phase coarsened.

From the results in FIG. 4, it was found that when the temperature that the amorphous alloy having the composition of $Fe_{84}B_{13}Ni_3$ itself reached was less than 475.48° C., the coercive force characteristic decrease rate was large. It is considered that the diffusion of atoms in the amorphous alloy is insufficient at the heat treatment temperature.

From the above, it was found that the soft magnetic material having a high saturation magnetization and a low coercive force and excellent in thermal endurance was obtained by heat-treating the amorphous alloy having the composition of $Fe_{84}B_{13}Ni_3$ under conditions in which the amorphous alloy was heated at a heating rate of 357° C./s to a temperature region of $\{T_1+0.88(T_2-T_1)\}$, that is, 475.48° C. or more to less than $T_2$, that is, 487° C., and held in the temperature region for a holding time of 3 s to 10 s.

All publications, patents and patent applications cited in the present description are herein incorporated by reference as they are.

DESCRIPTION OF SYMBOLS

1 Amorphous alloy

2 Block

3 Temperature controller

4 Heating wire (heating element) and heat-insulating material

What is claimed is:

1. A soft magnetic material represented by the following composition formula:

$$Fe_{100-x-y}B_xNi_y$$

wherein x satisfies $10 \le x \le 16$ in at %, y satisfies $0 < y \le 4$ in at %, part of B may be replaced by at least one element selected from the group consisting of Si, P, and C, the replaced B is 3 at % or less based on an entire composition, part of Fe and part of Ni may be replaced by at least one element selected from Nb, Co, Zr, Hf, Cu, Ag, Au, Zn, Sn, As, Sb, Bi, Y, and rare earth elements, and the replaced Fe and Ni is 3 at % or less based on the entire composition, having a coercive force of 20 A/m or less, and having a coercive force characteristic decrease rate after a thermal endurance test {[(coercive force after thermal endurance test−coercive force before thermal endurance test)/coercive force before thermal endurance test]×100 (%)} of 20% or less, wherein the thermal endurance test is carried out by allowing the soft magnetic material to stand in a constant temperature oven at 170° C. in the air for 100 h.

2. The soft magnetic material according to claim 1, wherein $12 \le x \le 14$ in at %.

3. The soft magnetic material according to claim 1, wherein $1 \le y \le 4$ in at %.

4. A method for producing a soft magnetic material, comprising:

providing an alloy having a composition represented by the following composition formula:

$$Fe_{100-x-y}B_xNi_y$$

wherein x satisfies $10 \le x \le 16$ in at %, y satisfies $0 < y \le 4$ in at %, part of B may be replaced by at least one element selected from the group consisting of Si, P, and C, the replaced B is 3 at % or less based on an entire composition, part of Fe and part of Ni may be replaced by at least one element selected from Nb, Co, Zr, Hf, Cu, Ag, Au, Zn, Sn, As, Sb, Bi, Y, and rare earth elements, and the replaced Fe and Ni is 3 at % or less based on the entire composition, and having an amorphous phase; and heat-treating the alloy under conditions in which the alloy is heated at a heating rate of 10° C./s or more to a temperature region of $\{T_1+0.88(T_2-T_1)\}$ or more to less than $T_2$, wherein $T_1$ is an α-Fe crystal formation start temperature, and $T_2$ is a Fe—B compound formation start temperature, and held in the temperature region for a holding time of 0 to 80 s.

5. The method according to claim 4, wherein a molten metal is quenched to provide the alloy.

6. The method according to claim 4, wherein the heating rate is 125° C./s or more.

7. The method according to claim 5, wherein the heating rate is 125° C./s or more.

8. The method according to claim 4, wherein the heating rate is 325° C./s or more.

9. The method according to claim 5, wherein the heating rate is 325° C./s or more.

10. The method according to claim 4, wherein the holding time is 3 s to 10 s.

11. The method according to claim 5, wherein the holding time is 3 s to 10 s.

12. The method according to claim 6, wherein the holding time is 3 s to 10 s.

13. The method according to claim 8, wherein the holding time is 3 s to 10 s.

14. The method according to claim 4, wherein the heat treatment is carried out by sandwiching the alloy between heated blocks.

15. The method according to claim 5, wherein the heat treatment is carried out by sandwiching the alloy between heated blocks.

16. The method according to claim 6, wherein the heat treatment is carried out by sandwiching the alloy between heated blocks.

17. The method according to claim 8, wherein the heat treatment is carried out by sandwiching the alloy between heated blocks.

18. The method according to claim 10, wherein the heat treatment is carried out by sandwiching the alloy between heated blocks.

19. The method according to claim 4, wherein $12 \leq x \leq 14$ in at %.

20. The method according to claim 4, wherein $1 \leq y \leq 4$ in at %.

* * * * *